United States Patent [19]

Sabin

[11] Patent Number: 4,928,958

[45] Date of Patent: May 29, 1990

[54] EXERCISE DEVICE

[75] Inventor: Jeffrey J. Sabin, Rossford, Ohio

[73] Assignee: Medical College of Ohio, Toledo, Ohio

[21] Appl. No.: 165,040

[22] Filed: Mar. 7, 1988

[51] Int. Cl.[5] ..... A63B 21/008

[52] U.S. Cl. ..... 272/96; 272/130; 272/900; 128/25 B

[58] Field of Search ..... 128/25 B; 272/130, 67, 272/68, 135, 136, 137, 96, 900

[56] References Cited

U.S. PATENT DOCUMENTS

| | | | |
|---|---|---|---|
| 2,806,699 | 9/1957 | Spooner | 272/67 X |
| 4,003,374 | 1/1977 | Mizrachy | 128/25 R X |
| 4,111,416 | 9/1978 | Jinotti | 272/900 X |
| 4,184,675 | 1/1980 | Rogerson | 272/130 X |
| 4,227,689 | 10/1980 | Keiser | 272/130 |
| 4,262,898 | 4/1981 | Lee | 272/68 |
| 4,480,832 | 11/1984 | Bulmash et al. | 272/130 |
| 4,575,076 | 3/1986 | Reichert et al. | 272/130 |
| 4,606,266 | 8/1986 | Hyman | 272/96 X |
| 4,772,016 | 9/1988 | Manion | 272/130 |

FOREIGN PATENT DOCUMENTS

| | | | |
|---|---|---|---|
| 8200100 | 1/1982 | United Kingdom | 272/136 |

*Primary Examiner*—Richard J. Apley
*Assistant Examiner*—H. N. Flaxman
*Attorney, Agent, or Firm*—Emch, Schaffer, Schaub & Porcello Co.

[57] ABSTRACT

An exercise device for the lower extremities that can be mounted on a support and has a frame having a first leg and a second leg. The first and second legs have a first end and a second end. The first end of the first and second legs are pivotally connected. A cylinder is connected to the first and second legs for providing resistance. The resistance is produced when the second end of the second leg is moved in a direction toward the first leg. A resilient spring is connected to the second leg. The resilient spring moves the second end of the second leg away from the first leg. A control valve is operatively connected to the cylinder for varying the resistance of the cylinder. A pad is positioned on the second end of the first leg. The pad is positioned to be engaged by the user to pivot the second end of the first leg towards said second leg against the resistance provided by the cylinder. The resilient spring moves the second end of the first leg away from the second leg to return the first leg to the original position. The user repetitively moves the second end of the first leg towards the second leg to exercise the lower extremity.

13 Claims, 2 Drawing Sheets

EXERCISE DEVICE

BACKGROUND OF THE INVENTION

This invention relates to an exercise device for the lower extremities of a patient to assist in reducing or eliminating deep vein thrombosis as a complication for both trauma and post-operative orthopedic patients. In particular, the invention is directed to an exercise device that requires the patient to contract the soleus muscle to have this muscle act as a venous pump to reduce or eliminate the stasis of blood in the soleus venous system.

Deep vein thrombosis is a common complication that can arise in both trauma and post-operative orthopedic patients. The occurrence of deep vein thrombosis is very significant in patients that have undergone major joint replacement or sustained fractures. Patients that develop deep vein thrombosis can develop pulmonary emboli and the development of pulmonary emboli can result in death. Physicians are striving to eliminate the occurance of deep vein thrombosis in their bedridden patients. Several treatments exist to control the development of deep vein thrombosis. Anti-thrombotics, elastic stockings, compression pumps, and more recently the CPM machine for the knee have been used with varying degrees of success. All of the above treatments have limitations that have kept them from effectively dealing with deep vein thrombosis and the complications that can arise from this condition.

The soleus muscle, with its extensive venous plexus, is one of the major venous pumps in the leg. The exercise device of the present invention has been devised to encourage a patient to actively contract the soleus muscle during the post-operative period until the patient can resume walking and other normal activity to prevent the onset of deep vein thrombosis. This is a particularly important method of treatment as the stasis of blood in the soleus venous system has been implicated as a major factor in the development of deep vein thrombosis. Active contraction of the soleus muscle reduces stasis of blood by increasing blood flow in the veins of the soleus muscle.

The exercise device can be used in connection with other equipment such as a CPM knee machine and other devices that are appropriate for use by bedridden patients.

Accordingly, it is an object of the invention to develop an exercise device to reduce deep vein thrombosis in patients.

It is a further object of the invention to provide a simple and low cost exercise device that produces no side effects for the patient.

It is another object of the invention to provide an exercise device to contract the soleus muscle so that this muscle can act as a venous pump.

These and other objects of the invention will be more fully understood by reading the detailed description of the invention that follows.

SUMMARY OF THE INVENTION

An exercise device for the lower extremities is disclosed. The exercise device can be mounted on a support and has a frame having a first leg and a second leg. The first and second legs having a first end and a second end. The first end of the first and second legs are pivotally connected. A means for providing resistance is connected to the first and second legs. The resistance means acting to provide resistance when the second end of the second leg is moved in a direction toward the first leg. A resilient member is connected to the second leg. The resilient member acting to move the second end of the second leg away from the first leg. A control means is operatively connected to the resistance means for varying the resistance of the resistance means. A pad is positioned on the second end of the first leg. The pad is positioned to be engaged by the user to pivot the second end of the first leg towards said second leg against the resistance provided by the resistance means. The resilient member acting to move the second end of the first leg away from the second leg to return the first leg to the original position. The user repetitively moves the second end of the first leg towards the second leg to exercise the lower extremity.

DESCRIPTION OF THE PREFERRED EMBODIMENT

The present inventions relates to an exercise device for the lower extremities that can be mounted on a support. More particularly, the exercise device allows a post-operative or bedridden patient to actively contract the soleus muscle during the post-operative period until the patient can get up and resume walking. The details of the invention will be more fully understood by referring to the attached drawings in connection with the following description.

Figure 1:
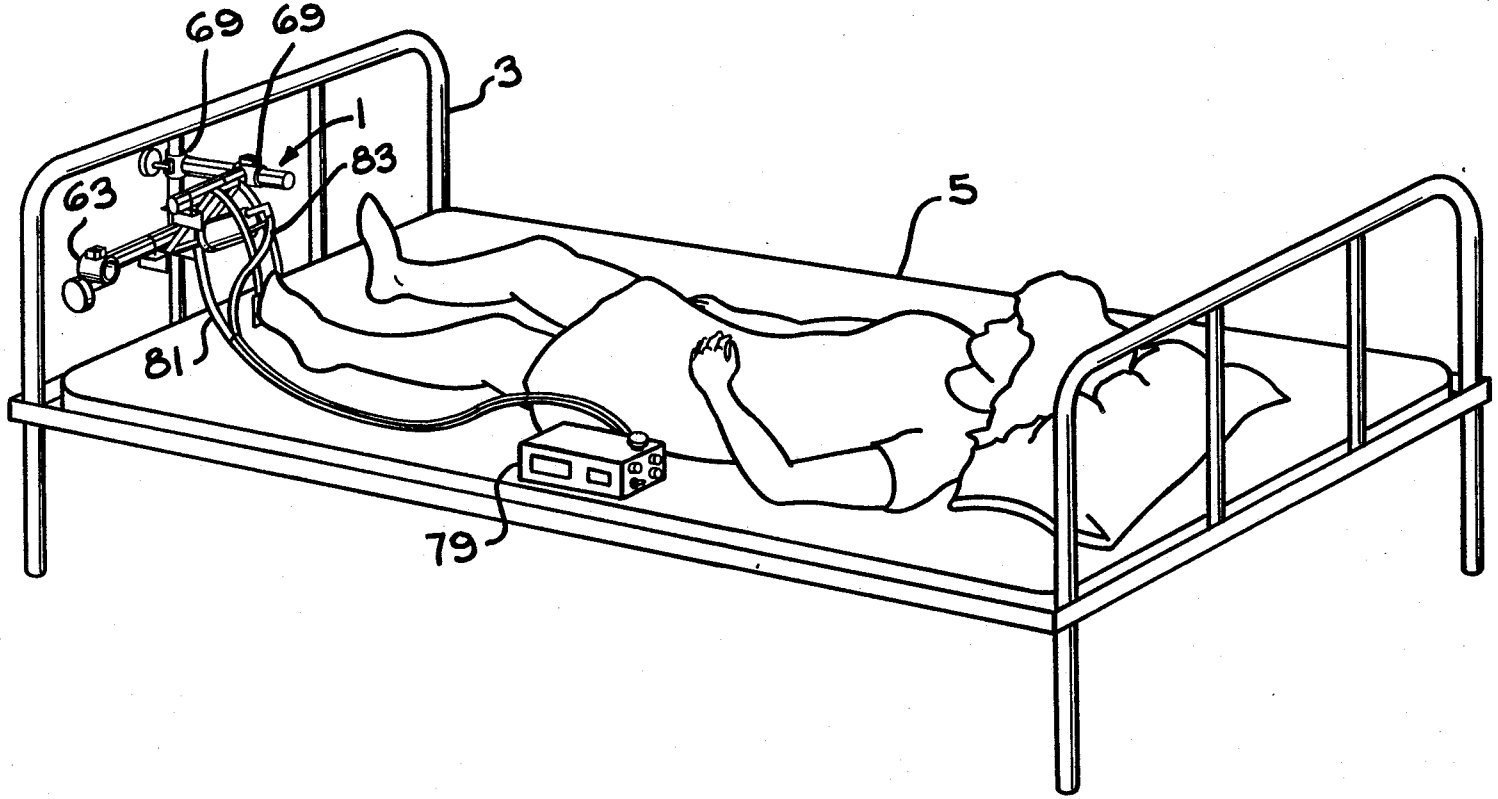
FIG. 1 is a perspective view of the exercise device of the present invention as being used by a patient.

In FIG. 1, the exercise device 1 is shown on the end frame member 3 of a bed 5. The exercise device 1 is mounted so that it is adjacent the foot of a patient lying on the bed. The details of the exercise device will be more fully understood by referring to FIG. 2. The exercise device has a frame 9 having a first leg 11 and a second leg 13. The first leg 11 is comprised of two spaced apart bars 12 that are positioned in opposed and parallel relationship. The second leg 13 is comprised of two spaced apart bars 14 that are positioned in opposed and parallel relationship. The first leg 11 has a first end 15 and a second end 17. The second leg 13 has a first end 19 and a second end 21. The first end 15 of the first leg 11 and the first end 19 of the second leg 13 are pivotally connected together by a pin 25.

A pneumatic cylinder 29 is secured to the first leg 11 at a pin 31 that extends between the two bars 12 that form the first leg 11. Usually the pneumatic cylinder 29 is welded or otherwise secured to the pin 31. The pneumatic cylinder 29 has a piston located in the interior of the cylinder (not shown) which is a standard feature for such a pneumatic cylinder. A rod 33 is connected to the piston and extends from the end of the pneumatic cylinder 29 that is spaced apart from the first leg 11. The end of the rod 33 that is spaced apart from the pneumatic cylinder 29 is secured to a pin 35 that extends between the bars 14 of the second leg 13. The pin 35 is located adjacent the second end 21 of the second leg 13. An outlet port 37 is provided in the pneumatic cylinder 29 on the end of the cylinder that is adjacent the first leg 11. The outlet port 37 is position on the side of the piston that is opposite the side of the piston to which the rod 33 is connected. A valve means 39 having a handle 41 is operatively connected to the outlet port 37. The handle can be moved to control the opening of the valve means to control of size of the opening connected to the outlet port 37.

Positioned around the pin 25 that pivotally connects the first leg 11 and the second leg 13 is a spring means 43. The spring means 43 has stems 45 that extend from each end of the spring along the bars 12 of the first leg 11 and the ends of the stems 45 are spaced away from the pin 25 engage the bars 12. The center portion 47 of the spring means 43 extends in a direction that is substantially parallel to the bars 14 of the second leg 13 and engages pin 49 that extends between the bars 14. The spring means 43 is disposed so that the stems 45 and the center portion 47 act upon to push the second end 17 of the first leg 11 away from the second end 21 of the second leg 13. The movement of the second end 17 of the first leg 11 away from the second end 21 of the second leg 13 is limited by the rod 33 and piston of the pneumatic cylinder 29. When the piston is at the end of the pneumatic cylinder 29 that is spaced apart from the pin 31 this acts to prevent the second end 17 of the first leg 11 moving any further away from the second end 21 of the second leg 13.

Positioned on the second end 17 of the first leg 11 is a pad 51. The pad 51 extends between and is securely fastened to the bars 12 that form the first leg 11.

Figure 2:
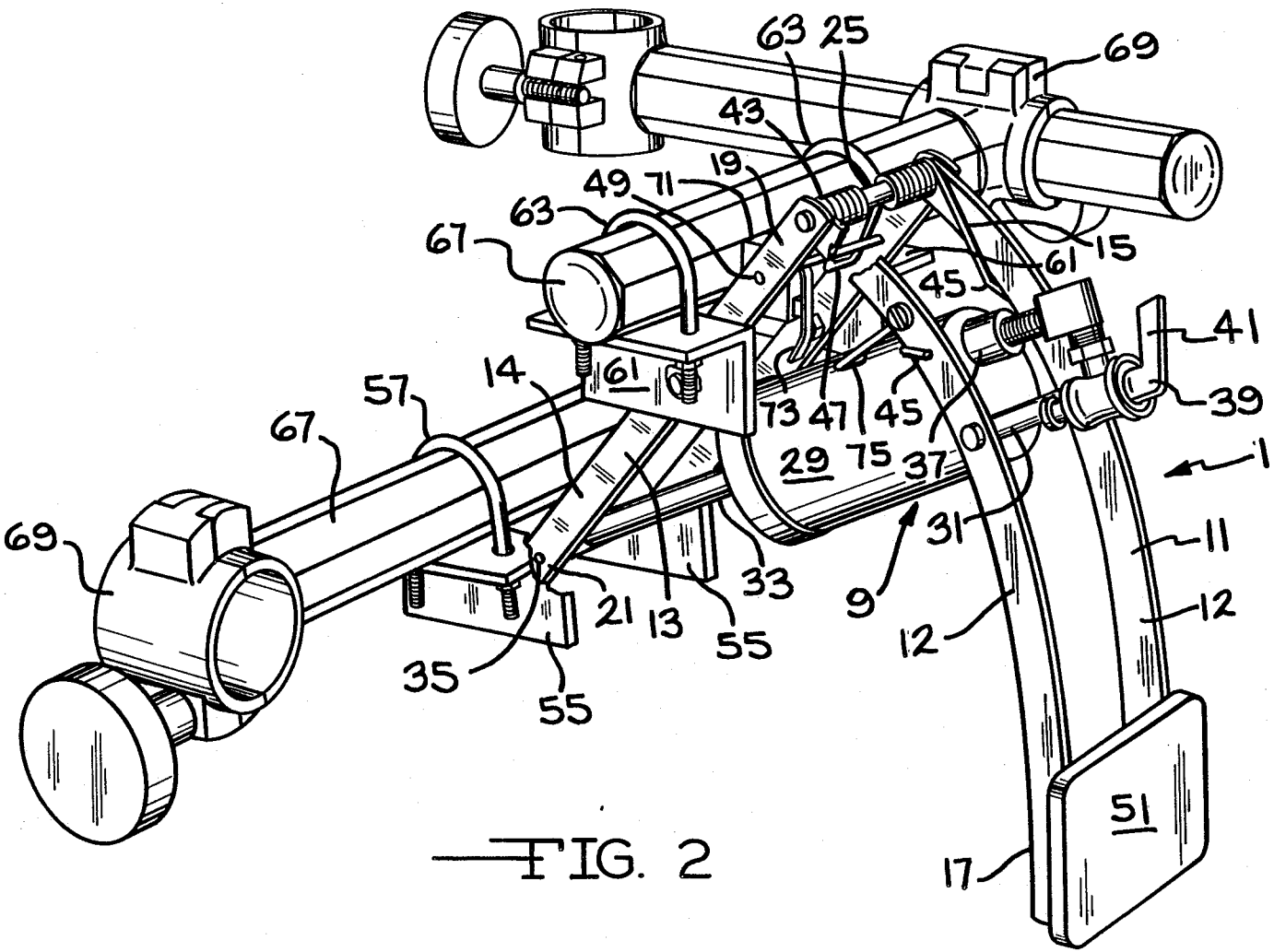
FIG. 2 is a perspective view of the exercise device of the present invention.

Positioned on the second end 21 of the bars 14 that form the second leg 13 are mounting flanges 55. A fastener 57 is secured to the mounting flanges 55 and is shown in FIG. 2, the fastener is in the form of a U-bolt. However, it should be understood that other types of fasteners can be used in connection with the mounting flanges 55. Mounting flanges 61 are also positioned on the bars 14 that form the second leg 13 adjacent the pin 49. The mounting flanges 61 also have a fastener 63 mounted thereon as shown in FIG. 2. This fastener is in the form of a U-bolt. However, it should be understood that other types of fasteners could be used in connection with the mounting flanges 61. The mounting flanges 55 and 61 allow the exercise device 1 to be connected to sections of tubing 67 and secured to the tubing by the use of the fasteners 57 and 63. Usually the sections of tubing 67 will contain releasable connectors 69 that allow the sections of tubing to be connected to other sections of tubing or to appropriate supporting struction for the exercise device. The sections of tubing 67 and releasable connector 69 are standard components that are utilized in hospitals to construct a traction apparatus or overhead frame for a bedridden patient. The use of these standard components allow the exercise device 1 to be mounted in a manner that is familiar to hospital personnel and also in a way that utilizes the types of materials that are normally available in a hospital environment.

Positioned on one of the bars 14 adjacent the pin 25 is a counter device 71. Connected to the counter device 71 is a movable bar 73. Positioned on one of the bars 12 that forms the first leg 11 is a trip wire 75. The trip wire 75 is disposed to engage the movable bar 73 of the counter device 71 when the second end 17 of the first leg 11 is moved in a direction toward the second end 21 of the second leg 13.

As shown in FIG. 1, a remote control box 79 can be connected to the exercise device 1. A wire 81 extends from the counter device 71 into the remote control box 79. A control cable 83 is connected to the valve means 39 and also extends to the remote control box 79.

In operation the exercise device 1 is positioned on the end frame member 3 of the bed or otherwise secured to appropriate support structure so that the exercise device is positioned adjacent a patient lying on the bed. Normally the patient will be a post-operative patient or a patient that is confined to bed and not capable of walking. It is preferable to position the exercise device 1 so that it is positioned above the surface of the mattress of the bed so that the exercise device does not interfere with hospital personnel that have to make or change the bed. The releaseable connectors 69 make it very easy to secure the exercise device to the appropriate support structure.

The pad 51 positioned on the second end 17 of the first leg 11 should be positioned adjacent the ball of the foot of the patient. To utilize the exercise device, the patient pivots the foot at the ankle to advance the second end 17 of the first leg 11 in a direction towards the second end 21 of the second leg 13. As the second end 17 of the first leg 11 is advanced, the piston in the pneumatic cylinder 29 is advanced towards the end of the pneumatic cylinder where the valve means 39 is located. The piston is caused to advance because the rod 33 connected to the piston is securely fastened to the second end 21 of the second leg 13. As the piston advances in the pneumatic cylinder 29 the air in the cylinder is compressed and discharged through the outlet port 37 and through the valve means 39. By positioning the handle 41, the opening in valve means 39 can be controlled. The size of the opening in the valve means controls how easy it is for the compressed air in the pneumatic cylinder 29 to escape from the outlet port 37. Thus, the valve means 39 can be used to control the resistance that is provided as the pad 51 is advanced towards the second end 21 of the second leg 13. Advancing the pad 51 towards the second end 20 of the second leg 13 also compresses the spring means 43.

As the pad 51 is advanced or pushed by the patient, the trip wire 75 mounted on the first leg 11 contacts the movable bar 73 on the counter device 71. The trip wire 75 causes the movable bar 73 to advance in a direction towards the second leg 13 and this activates the counter device 71. Each time the trip wire activates the counter device the repetition or stroke that the patient makes using the exercise device 1 is recorded. This provides the patient and medical staff with a record of the exercise that is accomplished by the patient. If the remote control box 79 is being utilized, the wire 81 sends the signal to the remote control box and a readout screen on the box keeps track of the repetitions the patient has made using the exercise device. The counter device 71 and the trip wire 75 require the patient to advance the pad 51 a sufficient distance to effectively contract the soleus muscle. If the pad 51 is not advanced a sufficient distance, the movable bar 73 of the counter device 71 is not be moved by the trip wire 75 and the counter device does not record the movement as a repetition that has been completed on the exercise device. This is particularly significant as most patients would be given a target number of repetitions to complete using the exercise device to obtain a desired number of contractions for the soleus muscle. This gives the patient and the attending medical personnel an opportunity to observe and insure that the patient is obtaining the desired degree of exercise to lessen the incidence of deep vein thrombosis. After the patient has advanced the pad 51 a sufficient distance, the foot of the patient is pivoted back towards its original starting position and the spring means 43 acts on the first leg 11 of the frame 9 to advance the pad 51 back to the original starting position so that the patient can perform another repetition on the exercise device 1.

The handle 41 on the valve means 39 can be positioned to control the amount of air that is allowed to escape from the outlet port 37. This effectively controls the resistance that is provided by the pneumatic cylinder 29 and thereby the force that is required for the patient to apply to the pad 51 to complete a repetition on the exercise device. Depending on the condition and strength of the patient, the resistance can be effectively controlled so that the patient is exercising the soleus muscle in the desired manner. For most applications the resistance will be relatively low as it is necessary only to contract the soleus muscles so that it operates as a venous pump to reduce or eliminate stasis of blood in the soleus venous system. If the remote control box 79, as shown in FIG. 1, is being utilized, a control cable 83 can be connected to the valve means 39 to give the patient the ability to control the setting of the valve means 39 on the remote control box so it is easier for the patient to effectively control the resistance provided by the pneumatic cylinder 29.

Having described the invention in detail, it should be understood that various modifications and changes can be made in the invention without departing from the scope and spirit of the following claims.

I claim:

1. An exercise device for the soleus muscle of the lower extremities to reduce deep vein thrombosis as a complication for both trauma and post-operative patients that can be mounted on a support comprising:

a frame having a first leg and a second leg, said first and second legs each having a first end and a second end, said first end of said first and second legs being pivotally connected;

a means for providing resistance being connected to the first and second legs, said resistance means having a cylinder with a movable piston positioned in the cylinder and a rod connected to the piston and extending from the cylinder, the cylinder being connected to said second leg of said frame and said rod being connected to said first leg, a discharge port positioned in said cylinder on the side of said piston that is opposite to the side of said piston where said rod is connected, whereby advancing said second end of said first leg towards said second leg causes said piston to move in said cylinder and to discharge fluid from said discharge port to provide resistance to the movement of said second leg;

a resilient member connected to said second leg, said resilient member acting to move said second end of said first leg away from said second leg;

a control means for varying the resistance of said resistance means, said control means being a valve that is operatively connected to said discharge port, said valve controlling the effective opening of said discharge port to control the resistance provided by said resistance means; and, means for mounting said frame to a support.

2. The device of claim 1, wherein said first and second legs are each comprised of two spaced apart bars that are positioned in opposed parallel relationship.

3. The device of claim 2, wherein a pin passes through said first end of said first and second legs to pivotally connect said first and second legs.

4. The device of claim 3, wherein said resilient member is a spring that acts upon said first leg to urge said second end of said first leg away from said second leg.

5. The device of claim 4, wherein said spring is a coil spring placed on said pin, said end of said spring extending and engaging said first leg.

6. The device of claim 1, wherein said second leg is securely connected to a support bracket whereby said second end of said first leg can be advanced toward said second leg by the lower extremity of the user to maintain the desired circulation in the lower extremity.

7. The device of claim 6, wherein said support bracket can be connected to the end of a bed and said support bracket can be adjusted to provide the proper positioning of the device.

8. The device of claim 7, wherein said support bracket mounts said device in spaced apart relationship with the surface of said bed.

9. The device of claim 1, wherein a counting device is operatively connected to the exercise device to allow the user to monitor the number of repetitions performed on the exercise device.

10. The device of claim 1, wherein a remote control is provided for said valve means to allow the user to control the resistance for said exercise device.

11. An exercise device for the soleus muscle of the lower extremities to reduce deep vein thrombosis as a complication for both trauma and port-operative patients comprising:

a frame having a first leg and a second leg, said first and second legs each having a first end and a second end, said first end of said first and second legs being pivotally connected, said second leg being securely connected to a support bracket;

a pneumatic cylinder with a movable piston positioned in the cylinder and a rod connected to the piston and extending from the cylinder, the cylinder being connected to said second leg of said frame and said rod being connected to said first leg, a discharge port positioned in said cylinder on the side of said piston that is opposite to the side of said piston where said rod is connected, advancing said second end of said first leg towards said second leg causes said piston to move in said cylinder and to discharge fluid from said discharge port to provide resistance when said second end of said first leg is moved in a direction towards said second leg;

a resilient member connected to said second leg, said resilient member acting to move said second end of said second leg away from said first leg;

a counting device operatively connected to said first and second legs to allow the user to monitor the number of repetitions performed on the exercise device;

a valve operatively connected to said discharge port, said valve controlling the effective opening of said discharge port to control the resistance provided by said pneumatic cylinder; and, means for mounting said frame to a support.

12. The device of claim 1, wherein a pad is positioned on the second end of the first leg, said pad being engaged by the user to pivot said second end of said first leg towards said second leg against the resistance provided by said resistance means, said resilient member acting to move said second end of said first leg away from said second leg to return said first leg to the original position, the user repetitively moving said second end of said first leg towards said second leg to exercise the lower extremity.

13. The device of claim 11, wherein a pad is positioned on the second end of the first leg, said pad being engaged by the user to pivot said second end of said first leg towards said second leg against the resistance provided by said resistance means, said resilient member acting to move said second end of said first leg away from said second leg to return said first leg to the original position, the user repetitively moving said second end of said first leg towards said second leg to exercise the lower extremity.

* * * * *